US010094100B2

(12) United States Patent
Merlo

(10) Patent No.: US 10,094,100 B2
(45) Date of Patent: Oct. 9, 2018

(54) WATER BACKUP PREVENTION SYSTEM

(71) Applicant: Stephen A Merlo, St. Louis, MO (US)

(72) Inventor: Stephen A Merlo, St. Louis, MO (US)

( * ) Notice: Subject to any disclaimer, the term of this patent is extended or adjusted under 35 U.S.C. 154(b) by 48 days.

(21) Appl. No.: 15/240,966

(22) Filed: Aug. 18, 2016

(65) Prior Publication Data

US 2018/0051453 A1 Feb. 22, 2018

(51) Int. Cl.
*E03F 7/04* (2006.01)
*E03F 5/10* (2006.01)

(52) U.S. Cl.
CPC ..... *E03F 7/04* (2013.01); *E03F 5/107* (2013.01); *E03F 2201/40* (2013.01)

(58) Field of Classification Search
CPC .... E03F 7/04; E03F 5/107; E03B 9/06; F16K 37/0041; H01H 35/405; G01F 1/363
USPC ..... 702/55; 251/318; 405/37; 137/299; 73/861.47
See application file for complete search history.

(56) References Cited

U.S. PATENT DOCUMENTS 3,202,165 A * 8/1965 Yavicoli ..... E03F 7/04 137/107
3,851,127 A * 11/1974 Gardner, Jr. ..... B67D 1/0037 200/61.86
4,272,640 A * 6/1981 Baumbach ..... E03F 7/04 137/110
4,513,184 A * 4/1985 Hughes ..... H01H 35/405 200/81.9 M
5,161,911 A 11/1992 Regan
8,087,311 B2 1/2012 Merlo
9,562,623 B2 * 2/2017 Clark ..... F16K 37/0041
2002/0007854 A1 * 1/2002 Dilger ..... G01F 1/363 137/554
2005/0072469 A1 * 4/2005 Preul ..... E03F 5/102 137/247.13
2008/0156121 A1 * 7/2008 Radomsky ..... F16K 37/0083 73/865.8
2009/0185862 A1 * 7/2009 Calzadilla ..... E03F 5/042 405/37
2010/0294373 A1 * 11/2010 Haller ..... F16K 37/0041 137/1
2011/0140908 A1 * 6/2011 Kosht ..... H04Q 9/00 340/870.02
2011/0308638 A1 * 12/2011 Hyland ..... E03B 9/06 137/299

OTHER PUBLICATIONS

Web page of Flood Guard product, available prior to Aug. 18, 2016.

* cited by examiner

*Primary Examiner* — Albert Wong
(74) *Attorney, Agent, or Firm* — David H. Chervitz

(57) ABSTRACT

A water backup prevention system is disclosed which has a valve and sensor assembly for being in a first position indicative of a normal condition and second position indicative of a water backup event, the valve and sensor assembly having a device for sensing when the valve and sensor assembly is in the second position and for generating a signal indicative of the water backup event, and a receiver device for receiving the signal indicative of the water backup event.

14 Claims, 7 Drawing Sheets

WATER BACKUP PREVENTION SYSTEM

BACKGROUND

This disclosure relates generally to a water backup prevention system, and more particularly to a water backup prevention system for preventing sewage or sewer backup in a residential or commercial environment and providing an indication that a backup event has occurred or is about to occur.

Sewer lines are used to move raw sewage and waste water from a house or a commercial site to a waste water treatment plant to be processed before the treated water is provided to a water source. Although the sewer lines are designed to convey only waste water it is known that ground or storm water may infiltrate the sewer lines through defects, cracks, or holes. The ground or storm water may cause backup problems within a structure. Further, when leaking sewer lines allow infiltration of ground water into the sewer lines, soil particles may be suspended in the ground water and flow into the sewer line, leaving voids in the soil where the soil particles eroded. The erosion leads to the sewer line not being supported in the ground and the sewer line being broken. These defects can cause other problems such as potholes, sinkholes, collapse of streets and buildings. As can be appreciated, all of this should be avoided.

Basements may flood from sewer line water backup. Sewer line water backup may occur during a rain storm that produces a large amount of rain water that exceeds the flow capacity of a sewer system. If the sewer system is not of a sufficient size to be able to accommodate a heavy rainstorm then water backup will occur causing damage to a house or a commercial building. Even if the sewer system is of a sufficient size there still may be unusually heavy rainstorms that will still cause water backup into a basement. As can be appreciated, water and sewage may cause extreme damage to a basement and property and can be avoided.

There are valves that may be placed in drain openings in a building to prevent water backup. Although the valves are useful, the valves do not provide information remote from the valve that a water backup event is occurring or has occurred. If personnel are not alerted that a water backup event is occurring then individuals inside a building may still use faucets, toilets, and other devices connected to a drainage system. If such devices are continued to be used during a water backup event these devices could flood causing damage throughout the building. Again, as can be appreciated, this should be avoided to prevent damage.

The present disclosure of a water backup prevention system is designed to obviate and overcome many of the disadvantages and shortcomings experienced with water backup problems. Moreover, the present disclosure is related to a water backup prevention system that reduces or eliminates any water backup in a residential or commercial structure. The water backup prevention system of the present disclosure is also simple to use, to install, and automatically prevents water backup without requiring any operator intervention. Further, the water backup prevention system provides a signal indicative of a water backup condition to a remote location so that an operator can take action to prevent further water backup problems.

SUMMARY

In one form of the present disclosure, a water backup prevention system is disclosed which comprises a valve and sensor assembly for being in a first position indicative of a normal condition and second position indicative of a water backup event, the valve and sensor assembly having a device for sensing when the valve and sensor assembly is in the second position and for generating a signal indicative of the water backup event, and a receiver device for receiving the signal indicative of the water backup event.

In another form of the present disclosure, a water backup prevention system is disclosed which comprises a valve and sensor assembly having a top grille, a bottom ring, a flexible seal between the top grille and the bottom ring, a guide pin connected to a float plug, a clamp screw connected to the top grille and the bottom ring with tightening of the clamp screw for expanding the flexible seal, a magnet, the float plug having a magnetic field detector, a control circuit, and a transmitter with the float plug capable of being in a first position indicative of a normal condition and a second position indicative of a water backup event, the magnetic field detector for sensing when the float plug is in the second position and for generating a signal indicative of the water backup event, and a receiver device for receiving the signal indicative of the water backup event.

In yet another form of the present disclosure, a water backup prevention system comprises a valve and sensor assembly having a top grille having a drain hole, a bottom ring having a drain slot, a flexible seal between the top grille and the bottom ring with the top grille, the flexible seal, and the bottom ring forming an upper valve body, a float plug, a guide pin connected to the float plug and the top grille with the float plug being able to move relative to the upper valve body, a clamp screw connected to the top grille and the bottom ring with tightening of the clamp screw for expanding the flexible seal, a magnet positioned on the bottom ring, the float plug having a magnetic field detector, a control circuit, and a transmitter with the float plug capable of being in a first position indicative of a normal condition and a second position indicative of a water backup event, the magnetic field detector for sensing when the float plug is in the second position and for generating a signal indicative of the water backup event, and a receiver device for receiving the signal indicative of the water backup event.

In light of the foregoing comments, it will be recognized that the water backup prevention system of the present disclosure is used to prevent sewer line backup and to alert an individual of the event of a sewer line backup.

The present disclosure provides a water backup prevention system that may be used to prevent any damage associated with a sewer line backup.

The present disclosure provides a water backup prevention system that does not require any operator intervention to eliminate or prevent any sewer line backup.

The present disclosure provides a water backup prevention system that may alert an individual or an operator of a water backup condition with the individual or the operator being located a location remote from a residence or commercial site where the water backup prevention system is installed.

The present disclosure is directed to a water backup prevention system that greatly reduces any damage associated with water backup from a sewer line.

The present disclosure also provides a water backup prevention system that may be easily employed with highly reliable results in preventing sewer line backup.

The present disclosure further provides a water backup prevention system that is sturdy and capable of withstanding extended use in a harsh environment such as a sewer line.

The present disclosure provides a water backup prevention system that can be constructed using readily available materials and easily manufactured components.

The present disclosure also provides a water backup prevention system that may be used with existing sewer lines and does not require retrofitting existing sewer lines.

These and other advantages of the present disclosure will become apparent after considering the following detailed specification in conjunction with the accompanying drawings, wherein:

DETAILED DESCRIPTION OF THE PREFERRED EMBODIMENTS

Figure 1:
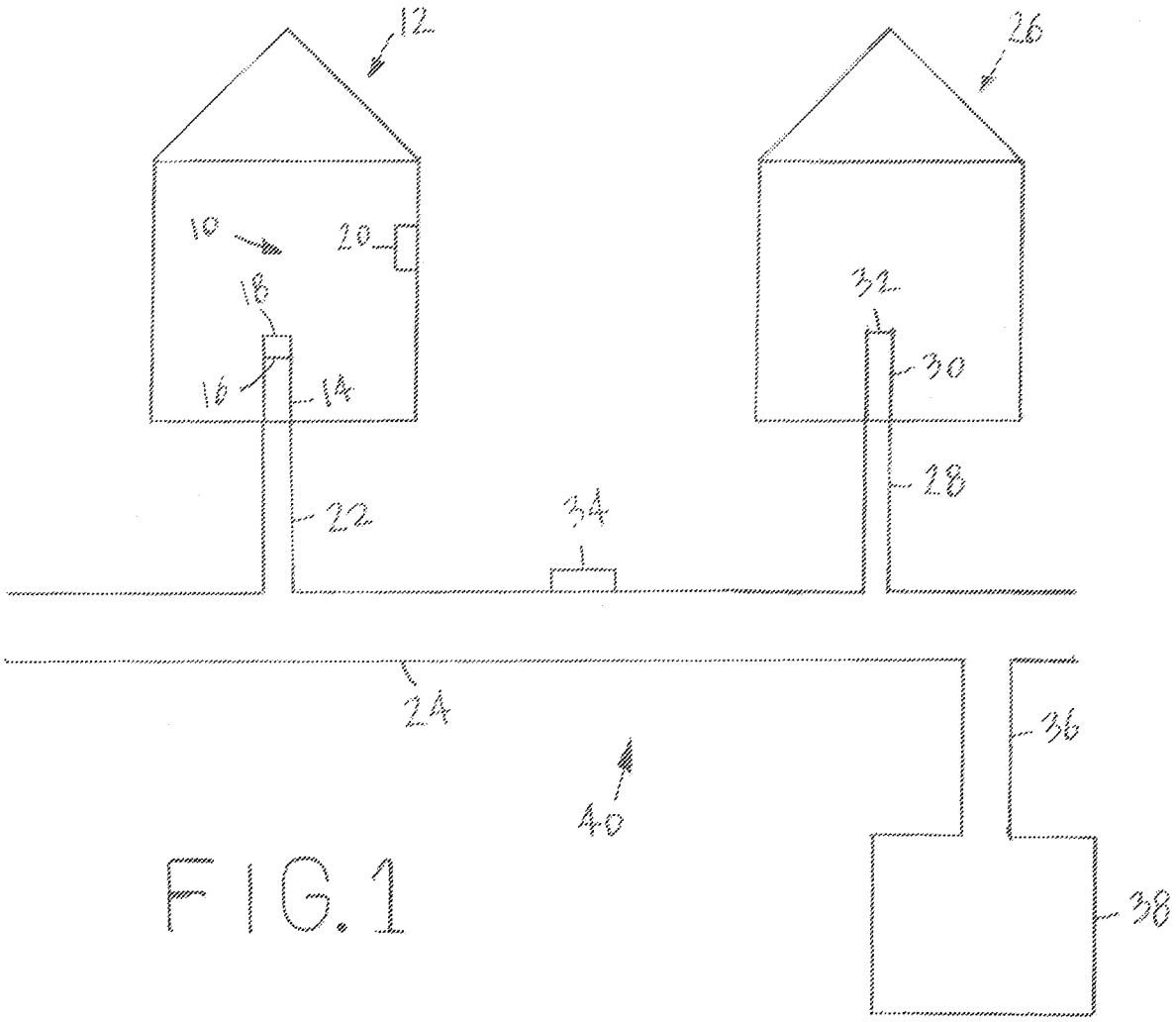
FIG. 1 is a schematic block diagram view of houses being connected to a sewage system with one of the houses having a water backup prevention system constructed according to the present disclosure installed therein.

Referring now to the drawings, wherein like numbers refer to like items, number 10 identifies a preferred embodiment of a water backup prevention system constructed according to the present disclosure. With reference now to FIG. 1, the water backup prevention system 10 is shown being installed in a house 12 that has a drain pipe 14 having a drain pipe opening 16. A valve and sensor assembly 18 is inserted into the drain pipe opening 16 and is capable of communicating with a receiver device 20. As will be discussed in detail more fully herein, the valve and sensor assembly 18 and the receiver device 20 form the water backup prevention system 10. The drain pipe 14 is connected to a sewer line 22 which is in turn connected to a main sewer line 24. A second house 26 is connected to the main sewer line 22 by a sewer line 28. The second house 26 also has a drain pipe 30 having a drain pipe opening 32. The drain pipe 30 is connected to the sewer line 28. As can be appreciated, the second house 26 does not have the system 10 installed and is therefore unprotected and water backup may occur in the second house 26. The main sewer line 24 has a manhole 34. The main sewer line 22 branches off at a sewer line 36 that is connected to a treatment plant 38. Any waste water or sewage that makes its way to the treatment plant 38 is treated and then sent to a water source. The sewer lines 22 and 28, the main sewer line 24, the manhole cover 34, the sewer line 36, and the treatment plant 38 all form a sewage system 40.

During a rain storm water produced by the storm may enter the sewage system 40. Water may infiltrate the system 40 through leaks in the sewer lines 22, 28, or 36, the main sewer line 24, or the manhole 34. Storm water may flow into the sewage system 40 from roof downspouts, groundwater sump pumps, and street and driveway drains. If the sewage system 40 is not of a sufficient size then water from a heavy rainstorm will be sent back up the sewer lines 22 and 28, the drain pipes 14 and 30, and out through the drain pipe openings 16 and 32, unless it is somehow prevented. Further, if water backup is not prevented then water may cause damage to the houses 12 and 26 and to the drain pipes 14 and 30.

Figure 2:
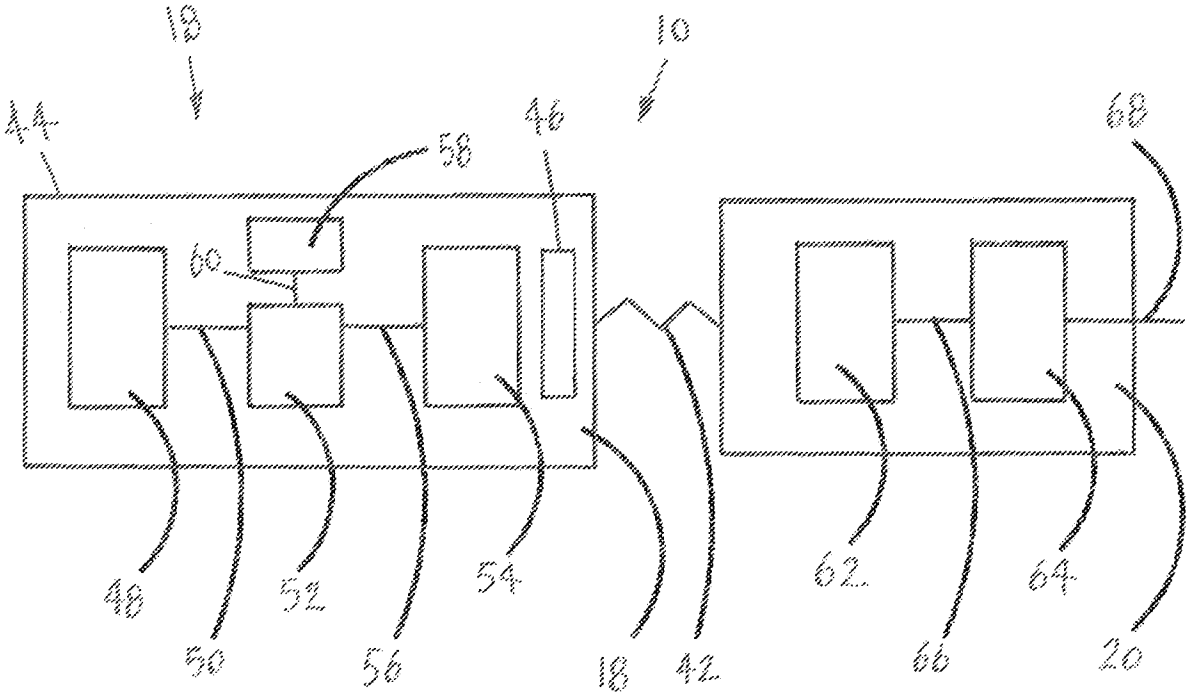
FIG. 2 is a block diagram of the water backup prevention system constructed according to the present disclosure.

FIG. 2 illustrates a block diagram of the water backup prevention system 10 constructed according to the present disclosure. The water backup prevention system 10 comprises the valve and sensor assembly 18 which is capable of communicating with the receiver device 20 via a radio signal 42. The valve and sensor assembly 18 comprises a valve assembly 44 having a magnet 46, a magnetic field detector 48 that is connected via a link 50 to a control circuit 52 with the control circuit 52 being connected to a transmitter 54 over a connection 56. The control circuit 52 is connected to an energy source, such as a battery 58, by a connection 60. The transmitter 54 is capable of generating and sending the radio signal 42 to the receiver device 20. Although a radio signal 42 is indicated, it is also possible that the assembly 18 may be hard wired to the receiver device 20. The receiver device 20 comprises a receiver 62 that is connected to a display 64 by a connection 66. The receiver device 20 may also have an external connection 68 that is capable of sending a signal over a network (not shown) to a cell phone, a smart phone, a paging device, or a building automation system. The signal sent over the network will indicate that a backup condition has occurred and that certain action may be taken. Although the valve and sensor assembly 18 will operate to block a backup, unless an individual or personnel are alerted that a backup condition or event has occurred, other individuals within a building may continue to flush water and sewage. This has the potential of creating a backup of material which originates inside the building and may cause damage away from the drain pipe 14 (FIG. 1). The system 10 being able to send a signal to alert personnel of the backup will enable personnel to take action such as alerting others in the building not to use any water devices, such as toilets or faucets. By way of example only and not limiting in any sense, the following components or devices may be used in constructing the assembly 18 and the receiver device 20. The magnetic field detector 48 may be a magnetic sensor manufactured by Micro Magnetics of Fall River, Mass., such as part number STJ-001 or STJ-201. The control circuit 52 and the transmitter 54 may be a single chip or circuit such as that manufactured by Microchip Technology, Inc. of Chandler, Ariz., such as part number PIC12F529T48A. This chip is a microcontroller having an integrated radio frequency transmitter. The receiver 62 may be an rfRXD0420 Receiver Module also manufactured by Microchip Technology, Inc.

Figure 3:
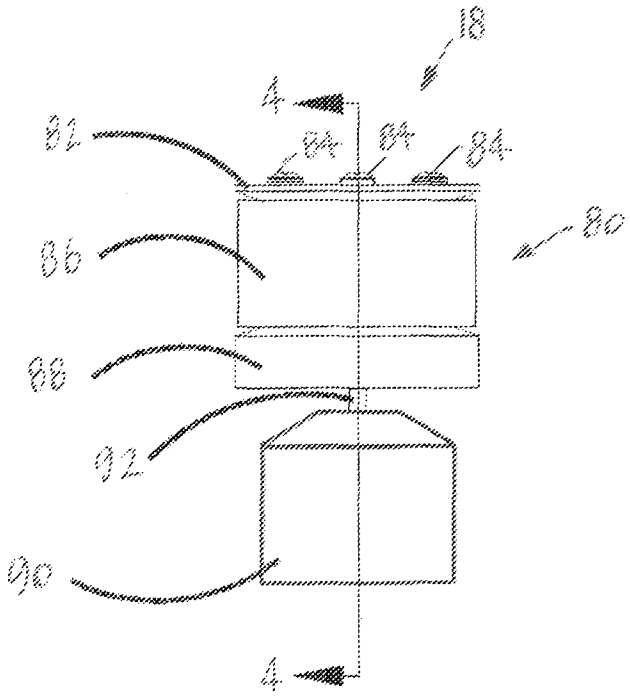
FIG. 3 is a side perspective view of a valve and sensor assembly shown in an open position.

With reference now to FIG. 3, a side perspective view of the valve and sensor assembly 18 is shown. The assembly 18 is shown in an open position or a deactivated condition in which no backup has been detected. The assembly 18 comprises an upper valve body 80 having a top grille 82 which may be held in place by clamp screws 84, a flexible seal 86, and a bottom ring 88. The assembly 18 also comprises a floating plug body or float plug 90 with the floating plug body 90 being connected to the upper valve body 80 by use of a guide pin 92. As can be appreciated, the floating plug body 90 is capable of moving upward to mate with the bottom ring 88 of the upper valve body 80 along the guide pin 92, as will be explained in more detail herein.

Figure 4:
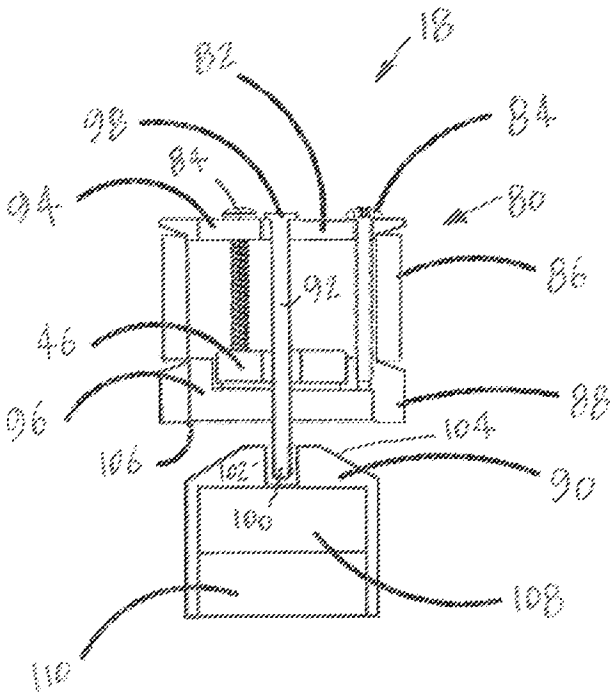
FIG. 4 is a cross-sectional view of the valve and sensor assembly taken along the plane of line 4-4 in FIG. 3.

FIG. 4 illustrates a cross-sectional view of the valve and sensor assembly 18. The valve and sensor assembly 18 is shown comprising the upper valve body 80 having the top grille 82, the clamp screws 84 which are connected to the bottom ring 88, a drain hole 94 formed in the top grille 82, a drain slot 96 formed in the bottom ring 88, and the magnet 46 positioned in the upper valve body 80 between the flexible seal 86 and the bottom ring 88. Although one drain hole 94 is illustrated in this particular view, as will be shown further herein, there may be more than one drain hole 94. The guide pin 92 extends through the upper valve body 80 and out through the top grille 82. The guide pin 92 has a flared top 98 and a threaded bottom end 100. The threaded bottom end 100 is threaded into an upper threaded portion 102 of the floating plug 90. As the floating plug 90 moves upward the guide pin 92 will also be free to move upward. Although the guide pin 92 is disclosed, it is also possible to use a fixed post that will allow the floating plug 90 move relative to the bottom ring 88. The floating plug 90 has a chamfered top end or sealing surface 104 that is capable of mating with a bottom end 106 of the upper valve body 80. In this manner, the sealing surface 104 will seal or close off the drain slot 96 and no water or sewage will be able to flow or escape through the upper valve body 80 and out through the top grille 82. The floating plug 90 also has the various electrical components 48, 50, 52, 54, 56, 58, and 60, all of which are not shown in this view, placed in an upper compartment 108 of the floating plug 90. As previously indicated, the assembly 18 is depicted in an open position or a deactivated condition in that the magnetic field detector 48 (not shown) is not close enough to the magnet 46 to detect the presence of a magnetic field. The floating plug 90 also has a flotation space 110 formed below the upper compartment 108. The flotation space 110 is capable of receiving water or sewage therein to push the float plug 90 in an upward direction. Although the flotation space 110 in the float plug 90 is depicted as being hollow, it is contemplated that the space 110 may be filled in to further isolate the electrical components 48, 50, 52, 54, 56, 58, and 60 from any water infiltration. By way of example only, the float plug 90 may have a bottom. It is also contemplated that the magnet 46 may be in the float plug 90 and the electrical components 48, 50, 52, 54, 56, 58, and 60 may be placed in the bottom ring 88.

Figure 5:
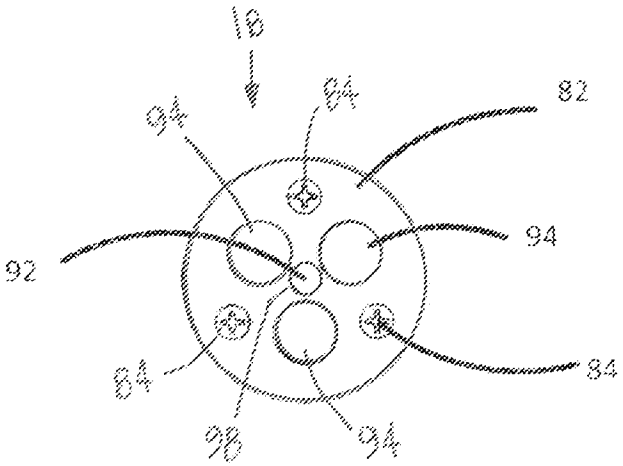
FIG. 5 is a top view of the valve and sensor assembly constructed according to the present disclosure.

Referring now to FIG. 5, a top view of the valve and sensor assembly 18 is depicted. The assembly 18 is shown having the top grille 82, the clamp screws 84, the flared top 98 of the guide pin 92, and the drain holes 94. Any water or other matter or debris that passes by the top grille 82 may enter the assembly 18 through the drain holes 94. The top grille 82 prevents any large material from entering the assembly 18 which would clog the assembly 18. The top grille 82 also acts as part of a sealing mechanism to retain the assembly 18 in the drain pipe opening 16 (FIG. 1) of the drain pipe 14 (FIG. 1). In particular, the top grille 82 is positioned below a grate (not shown) with the grate being used to cover the drain pipe opening 16 of the drain pipe 14. The assembly 18 is shown in a open or deactivated position and the flared top 98 of the guide pin 92 is flush with the top grille 82. The flared top 98 being flush with the top grille 82 is also a visual indication that the assembly 18 has not been activated or that no water backup has been sensed or detected.

Figure 6:
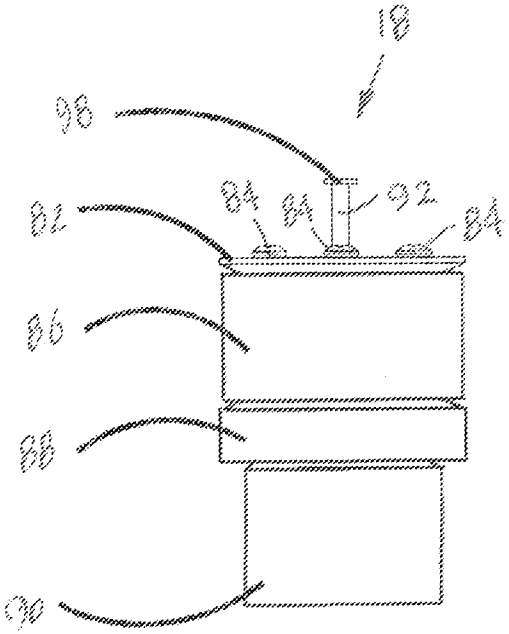
FIG. 6 is a side view of the valve and sensor assembly shown in a closed position.

FIG. 6 shows the assembly 18 in a closed position or an activated condition. In particular, the floating plug 90 has moved upward so that the top end 104 (not shown) is mating with the bottom end 106 (also not shown) of the bottom ring 88. The guide pin 92 and the flared top 98 have also moved upward and extend out from the top grille 82. Again, this is a visual indicator that the assembly 18 has been activated and that a water backup event has occurred or is occurring. As can be appreciated, although not shown in this particular drawing, the magnetic field detector 48 is now in a close position to the magnet 46 so that the magnetic field detector 48 now detects the magnet 46. The clamp screws 84 and the flexible seal 86 are also shown.

Figure 7:
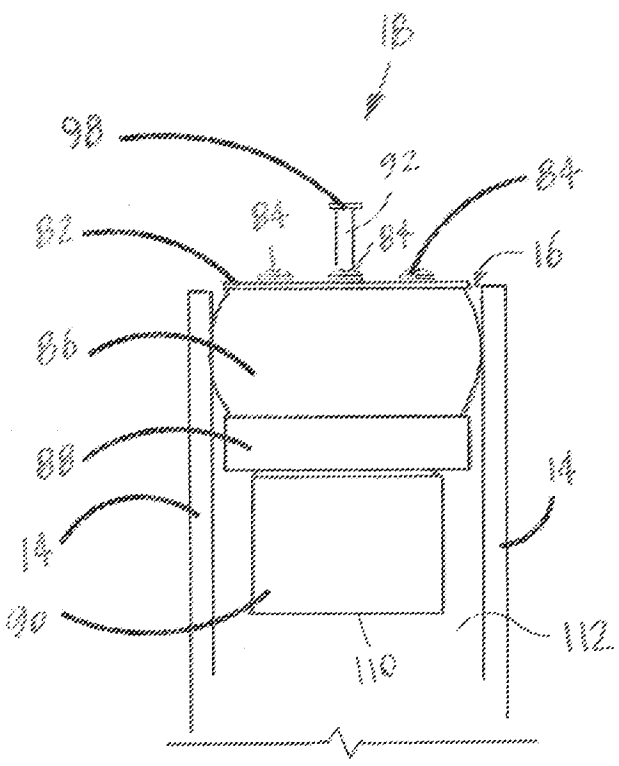
FIG. 7 is a side view of the valve and sensor assembly shown in a closed position and installed in a drain pipe.

With particular reference now to FIG. 7, the valve and sensor assembly 18 is illustrated being installed in the drain pipe opening 16 of the drain pipe 14 in which a water backup event or condition has occurred due to water 112 being in the drain pipe 14. As has been previously described, the assembly 18 is installed in the drain pipe 14 below the grate, which has not been shown in FIG. 7. The water 112 has filled the flotation space 110 which has caused the float plug 90 to move upward. The float plug 90 has been sealed against the bottom ring 88. In this position no water 112 may flow through the assembly 18 and out of the drain holes 94 (not shown). Further, although not shown, the magnetic field detector 48 is now in close proximity to the magnet 46 so that the detector 48 generates a signal indicative of a water backup condition being sensed by the assembly 18. The flexible seal 86, which has been inserted into the drain pipe 14, also protects against any of the water 112 from escaping through the drain pipe opening 16. The flexible seal 86 is expanded by tightening the clamp screws 84 so that the bottom ring 88 moves toward the top grille 82. As can be appreciated, the flexible seal 86 is used to form a water tight seal between the seal 86 and the drain pipe 14 and to retain the assembly 18 within the drain pipe 14. Although the flexible seal 86 is shown as being a bladder type device, it is also possible that the flexible seal 86 may include other structure or features to further retain the seal 86 within the drain pipe 14. By way of example only, the flexible seal 86 may include sharp points that dig into the drain pipe 14 or circular ribs that assist in sealing the assembly 18 within the drain pipe 14.

In operation, the assembly 18 is inserted into the drain pipe opening 16 of the drain pipe 14. The clamp screws 84 are then tightened to expand the flexible seal 86 into engagement with the drain pipe 14. In this position, the float plug 90 will hang down away from the bottom ring 88. The guide pin 92 will be resting against the top grille 82. The magnetic field detector 48 will be a sufficient distance away from the magnet 46 so that no detection of the magnet 46 is made. Any water that enters through the drain holes 94 will pass through drain slot 96 in the bottom ring 88 and into the drain pipe 14. The control circuit 52 may be programmed to send a signal indicative of the assembly 18 functioning properly or that no backup has been detected or exists. The signal may be sent on an intermittent basis to save the battery 58.

In the case of water backing up from the drain pipe 14, the sewer line 22, or the main sewer line 24, the float plug 90 will rise so that the sealing surface 104 will contact the bottom end 106 of the upper valve body 80. This seals the bottom end 106 and prevents any water from flowing from the drain pipe 14 through the drain slot 96 and out through the drain holes 94 in the top grille 82. The float plug 90 has now been moved into a position in which the magnetic field detector 48 detects the magnet 46. A signal is now sent over the connection 50 to the control circuit 52. The control circuit 52 is programmed to send a signal over the connection 56 to the transmitter 54. The transmitter 54 will now transmit a signal to the receiver device 20 for indicating the presence of water or other material being backed up in the drain pipe 14. The receiver 62 sends a signal over the connection 66 to the display 64 which will display a warning. The receiver device 20 may also send a signal by use of the external connection 68. It is also contemplated that the receiver device 20 may be hard wired to a paging device or a building automation system. It is further possible that the signal transmitted by the transmitter 54 of the assembly 18 may send the signal through a network, such as the Internet, directly to a cell phone or a smart phone.

Figure 8:
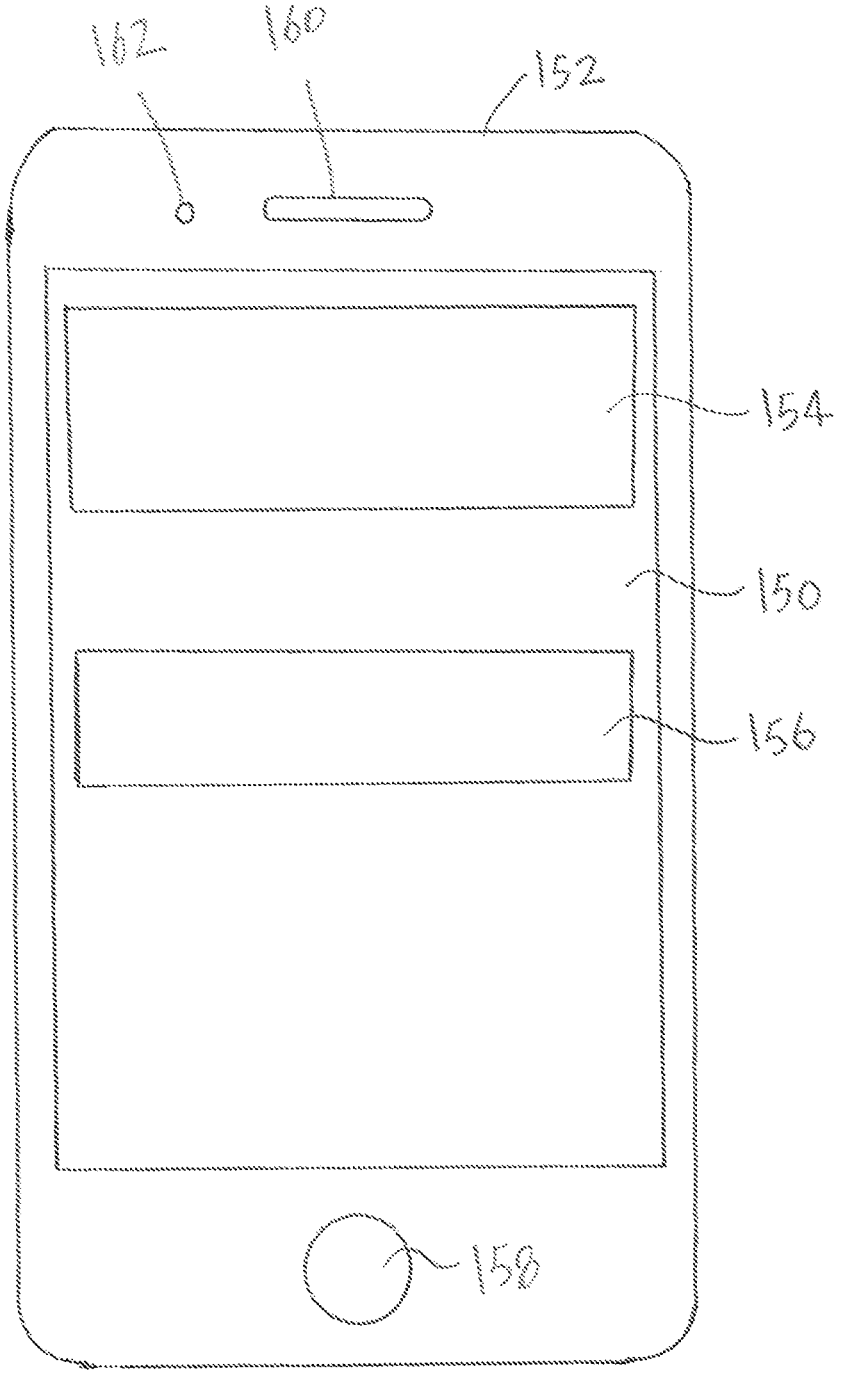
FIG. 8 is an illustration of a screen of a mobile communication device which may be presented during use of the water backup prevention system constructed according to the present disclosure.

FIG. 8 is an illustration of a screen 150 of a mobile communication device, such as a smart phone 152. The smart phone 152 may include a mobile software platform such as iPhone OS (Operating System), Android OS, Palm WebOS, Windows Mobile, or other similar mobile software platform that is capable of running a software program such as an application. The screen 150 has a message box 154 in which a message such as a backup event has been detected may be displayed. The application running on the phone 152 may include information in the message box 154 such as the location of the assembly 18 that triggered the signal of the backup event. In particular, there may be numerous assemblies 18 installed at numerous drain locations. For example, a school system may have ten different schools located at ten different addresses. Each of the assemblies 18 may have a unique code associated with the assembly 18. The unique code may be part of the signal sent by the external connection 68 (FIG. 2). The software resident in the smart phone 152 may be programmed to show the specific location of the assembly 18 and this information may be displayed in the message box 154. Another box 156 may be provided in the screen 150 that may include contact information of a person located at the site where the assembly 18 is so that the operator of the phone 152 may contact the person to take action at the site. The screen 150 may include other boxes or icons which are touch sensitive. The phone 152 may include other items such as a menu button 158, a speaker 160, and a visual indicator 162. Although not shown in detail, the phone 152 may include other input devices, as is known.

From all that has been said, it will be clear that there has thus been shown and described herein a water backup prevention system which fulfills the various objects and advantages sought therefor. It will be apparent to those skilled in the art, however, that many changes, modifications, variations, and other uses and applications of the subject water backup prevention system are possible and contemplated. All changes, modifications, variations, and other uses and applications which do not depart from the spirit and scope of the disclosure are deemed to be covered by the disclosure, which is limited only by the claims which follow.

What is claimed is:

1. A water backup prevention system comprising:

a valve and sensor assembly having a top grille, a bottom ring, a flexible seal between the top grille and the bottom ring, a guide pin connected to a float plug, a clamp screw connected to the top grille and the bottom ring with tightening of the clamp screw for expanding the flexible seal, a magnet, the float plug having a magnetic field detector, a control circuit, and a transmitter with the float plug capable of being in a first position indicative of a normal condition and a second position indicative of a water backup event, the magnetic field detector for sensing when the float plug is in the second position and for generating a signal indicative of the water backup event; and a receiver device for receiving the signal indicative of the water backup event.

2. The water backup prevention system of claim 1 wherein the float plug further comprises a flotation space capable of receiving water or sewage therein to push the float plug in an upward direction.

3. The water backup prevention system of claim 1 wherein the bottom ring comprises a bottom end and the float plug further comprises a sealing surface that is capable of mating with the bottom end.

4. The water backup prevention system of claim 1 wherein the top grille comprises a drain hole and the bottom end has a drain slot and water is capable of flowing through the drain hole and the drain slot.

5. The water backup prevention system of claim 1 wherein the receiver device comprises a receiver and a display.

6. The water backup prevention system of claim 5 wherein the receiver device further comprises an external connection that is capable of sending a signal over a network for indicating the water backup event.

7. The water backup prevention system of claim 1 wherein the control circuit is capable of generating a signal indicative of the status of the valve and sensor assembly, providing the signal indicative of the status of the valve and sensor assembly to the transmitter, and the transmitter for sending the signal indicative of the status of the valve and sensor assembly to the receiver device.

8. A water backup prevention system comprising:

a valve and sensor assembly having a top grille having a drain hole, a bottom ring having a drain slot, a flexible seal between the top grille and the bottom ring with the top grille, the flexible seal, and the bottom ring forming an upper valve body, a float plug, a guide pin connected to the float plug and the top grille with the float plug being able to move relative to the upper valve body, a clamp screw connected to the top grille and the bottom ring with tightening of the clamp screw for expanding the flexible seal, a magnet positioned on the bottom ring, the float plug having a magnetic field detector, a control circuit, and a transmitter with the float plug capable of being in a first position indicative of a normal condition and a second position indicative of a water backup event, the magnetic field detector for sensing when the float plug is in the second position and for generating a signal indicative of the water backup event; and a receiver device for receiving the signal indicative of the water backup event.

9. The water backup prevention system of claim 8 wherein the float plug further comprises a flotation space capable of receiving water or sewage therein to push the float plug in an upward direction.

10. The water backup prevention system of claim 8 wherein the bottom ring comprises a bottom end and the float plug further comprises a sealing surface that is capable of mating with the bottom end.

11. The water backup prevention system of claim 8 wherein the drain hole in the top grille and the drain slot in the bottom end are capable of allowing water to flow through the drain hole and the drain slot.

12. The water backup prevention system of claim 8 wherein the receiver device comprises a receiver and a display.

13. The water backup prevention system of claim 8 wherein the receiver device further comprises an external connection that is capable of sending a signal over a network for indicating the water backup event.

14. The water backup prevention system of claim 8 wherein the control circuit is capable of generating a signal indicative of the status of the valve and sensor assembly, providing the signal indicative of the status of the valve and sensor assembly to the transmitter, and the transmitter for sending the signal indicative of the status of the valve and sensor assembly to the receiver device.

* * * * *